US005127533A

United States Patent [19]

Virkkunen

[11] Patent Number: 5,127,533

[45] Date of Patent: Jul. 7, 1992

[54] METHOD OF DAMPING THE SWAY OF THE LOAD OF A CRANE

[75] Inventor: Jouko Virkkunen, Espoo, Finland

[73] Assignee: Kone Oy, Helsinki, Finland

[21] Appl. No.: 536,768

[22] Filed: Jun. 12, 1990

[30] Foreign Application Priority Data

Jun. 12, 1989 [FI] Finland ..... 892863

[51] Int. Cl.[5] ..... B66C 19/00

[52] U.S. Cl. ..... 212/147; 212/146

[58] Field of Search ..... 212/146-147, 212/149, 153, 159, 205

[56] References Cited

U.S. PATENT DOCUMENTS

| | | | |
|---|---|---|---|
| 3,517,830 | 6/1970 | Virkkala . | |
| 4,717,029 | 1/1988 | Yasunobu | 212/147 |
| 4,756,432 | 7/1988 | Kawashima et al. | 212/147 |

FOREIGN PATENT DOCUMENTS

| | | | |
|---|---|---|---|
| 3513007 | 12/1985 | Fed. Rep. of Germany | 212/147 |
| SE429641 | 9/1987 | Sweden . | |
| 1129174 | 12/1984 | U.S.S.R. | 212/146 |
| 1053443 | 5/1985 | U.S.S.R. | 212/146 |
| 1379238 | 3/1988 | U.S.S.R. | 212/147 |

OTHER PUBLICATIONS

"Pole-Placement Control of a Pilot Gantry" by Arto Marttinen, Proceedings of the 1989 American Control Conference, Jun. 21-23 1989, vol. 3, pp. 2824≧2826.

"Modelling and Analysis of a Trolley Crane," Proceedings of the Intern. AMSE Conference Modelling & Simulation, Pomona, Calif. (USA), Dec. 16-18, 1987, vol. 3, pp. 15-26.

"Computer Control of a Loading Bridge," IEE International Conference, Control '88, Oxford, UK, 13.-15. Apr. 1988.

"Nonlinear Modeling and Control of Overhead Crane Load Sway," Transactions of the ASME, vol. 110, Sep. 1988, pp. 266-271.

*Primary Examiner*—Sherman D. Basinger
*Assistant Examiner*—Thomas J. Brahan

[57] ABSTRACT

Procedure for damping the sway of the load (2) moved by the carriage (1) of a crane, said load being suspended on at least one hoisting rope (3). The damping is achieved by using a discrete time control system whose control interval is varied in accordance with the hoisting rope length (L) while the control parameters remain constant.

9 Claims, 2 Drawing Sheets

METHOD OF DAMPING THE SWAY OF THE LOAD OF A CRANE

FIELD OF THE INVENTION

The present invention relates to a procedure for damping the sway of the load moved by the carriage of a crane, said load being suspended on at least one hoisting rope.

BACKGROUND OF THE INVENTION

Overhead gantry cranes and pilot gantry cranes are known for use in material handling, especially where high load conditions exist. Such pilot gantry crane typically utilize a rope or cable hoisting mechanism.

In the control procedures currently used for damping the load sway in cases where the rope length may change during the lifting operation, several damping control parameters have to be trimmed during use. An example of such a control procedure is described in "Pole-Placement Control of a Pilot Gantry" by Arto Marttinen, Proceedings of the 1989 American Control Conference, Jun. 21-23, 1989, Vol. 3, pp. 2824-2826. This trimming requires a large amount of computation. In addition, the trimming procedures currently used for damping the load sway require a precise determination of the position of the load. For this reason, in the currently used procedures a detector for measuring the load position must be placed on the load in many cases. Alternatively, U.S. Pat. No. 3,517,830 to Virkkala issued Jun. 30, 1970 uses a simplified sway damping arrangement in which the rope length is maintained "constant" during load movement.

SUMMARY AND OBJECTS OF THE INVENTION

The object of the present invention is to eliminate the drawbacks referred to above. The procedure of the invention for damping the sway of the load of a crane is characterized in that the control interval of a discrete time control system is varied according to the length of the hoisting rope while the control parameters remain constant.

The preferred embodiments of the invention are presented in the other claims.

In the procedure of the invention, no re-trimming of the control parameters is required. This reduces the amount of computation. Moreover, in the procedure of the invention, the load position need not be determined.

BRIEF DESCRIPTION OF THE DRAWINGS

In the following, the invention is described in detail by the aid of an example by referring to the figures attached, wherein.

DETAILED DESCRIPTION OF THE PREFERRED EMBODIMENT

Figure 1:
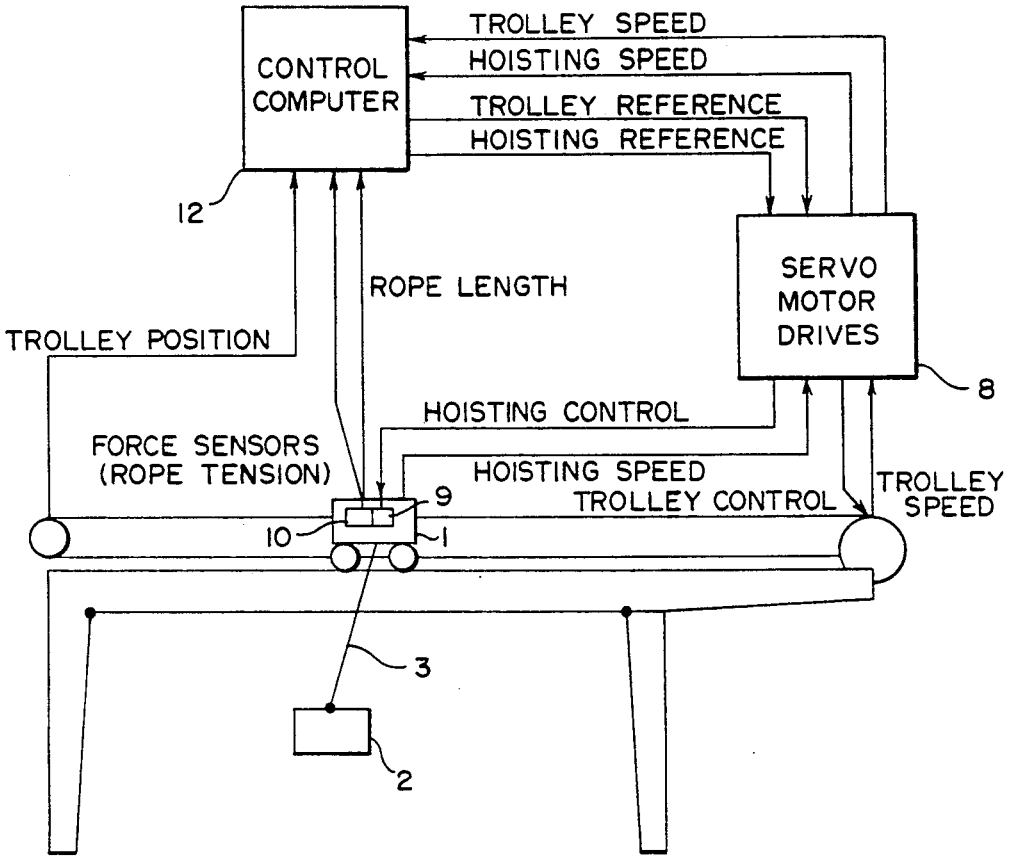
FIG. 1, is a schematic representation of a control system which may be utilized to implement the present invention on an exemplary crane.

FIG. 1 illustrates a typical control system for controlling a pilot gantry crane. The teachings of the present invention, however, may be used in any known crane control system exhibiting the problem of sway. The control system of FIG. 1 utilizes the method of damping load sway according to the teachings of the present invention. Specifically, a carriage 1 supports a load 2 on a hoisting rope or cable 3. A servomotor drive 8 controls the hoisting of the load 2 on the hoisting rope 3 through control of a hoist motor 9 schematically illustrated in this Figure. A rope length sensor 10 is further provided for sensing the length of the hoisting rope 3. For example, a simple circuit may be used to determine the length of the hoist rope based upon the amount of rope played from a rope drum or reel 6. Alternatively, the length can be independently measured by another form of telemetry, for example, radar or the like.

Figure 3:
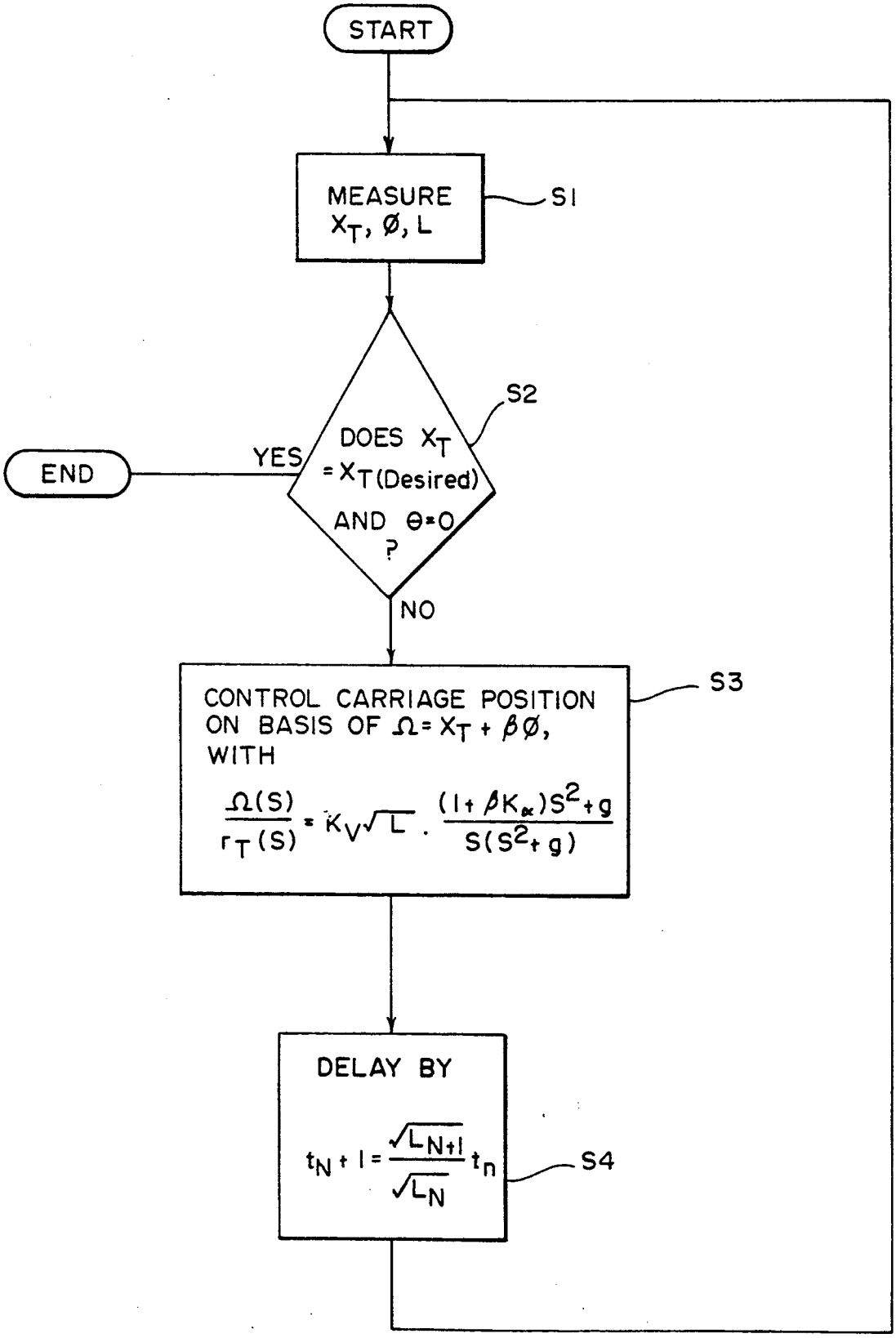
FIG. 3 is a flow chart illustrating the damping control utilized by the control computer 12 of FIG. 1.

The rope length L is provided to a control computer 12 which processes this information according to the teaching of the present invention as shown in Step S1 of FIG. 3 to provide suitable control signals to the servomotor drive 8 to control both the hoist motor and trolley positioning motor. Although FIG. 1 illustrates feedback of hoisting speed and trolley speed from the trolley 1 and trolley motor, according to the teachings of the present invention, these feedbacks are made unnecessary. Likewise, it would be possible to use open loop control to control the servomotor drive 8 using the control computer 12.

Figure 2:
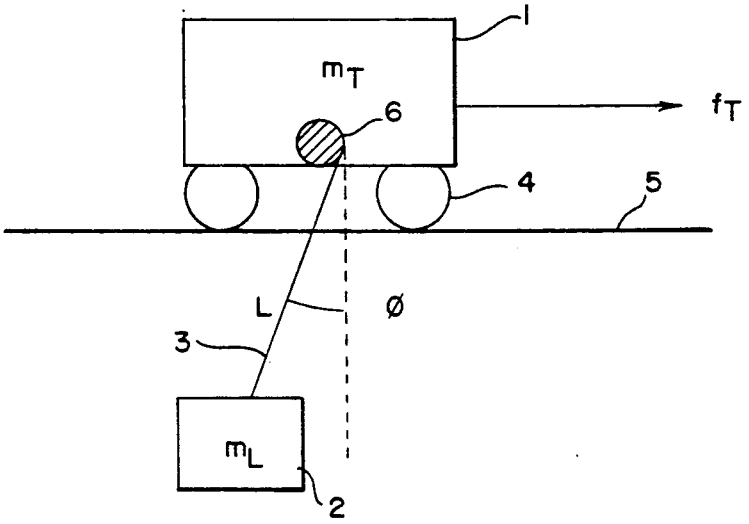
FIG. 2 is a simplified view of a carriage-and-load system illustrating various measurement parameters used in the method of damping of the present invention.

FIG. 2 shows a carriage 1, a load 2 and a hoisting rope 3. The carriage 1 moves on wheels 4 along rails 5. The hoisting rope 3 is wound on a reel 6. The mechanism moving the carriage 1 and the hoisting motor rotating the reel 6 are not shown in this figure.

Suppose that the motor hoisting the load 2 works nearly ideally, in which case the desired hoisting or lowering speed of the load is achieved in a very short time (the time needed for acceleration is not taken into account). Suppose further that the hoisting or lowering speed changes relatively slowly as compared to the rest of the dynamics of the crane. Leaving the dynamics of the motor drives out of account, the dynamics of the carriage-and-load system depends on the hoisting rope length L, the mass $m_L$ of the load and the mass $m_T$ of the carriage. Thus the force $f_T$ in the figure corresponds to the ideal carriage control moment. Equation 1 represents the transfer function of an ideal moment controlled crane, where $f_T$ is the control force, $x_T$ is the carriage position, $\delta$ is the damping resulting from the linear friction g is the force of gravity, s is the Laplace complex variable, $$\omega_o^2 = g/L$$

and $$\omega_n^2 = \left(\frac{m_T + m_L}{m_T}\right) g/L$$

$$\frac{x_T(s)}{f_T(s)} = \frac{s^2 + \omega_o^2}{s(s^3 + 2\delta\omega_n s^2 + \omega_n^2 s + 2\delta\omega_n\omega_o^2)} \quad (1)$$

The internal dry (coulomb) friction of the motor drives complicates the dynamics of the system and leads to non-linearities. By using fast tachometer feedback and speed reference, these difficulties can be eliminated. In this way, the internal equations of the system are simplified. They are independent of the friction terms, the reaction forces resulting from the mass of the load, and therefore also of the masses. Since the load position and swing are controlled by a single control signal, a new artificial transfer function is formed, which is used to control carriage position in accordance with the teachings of the present invention as shown by steps S2, S3 of FIG. 3 in which the swing angle $\phi$ and the carriage position $x_T$ are added together.

$$\frac{\Omega(s)}{r_T(s)} = K_V \frac{(1+\beta K\alpha)s^2 + g/L}{s(s^2 + g/L)} = \tag{2}$$

$$K_V\sqrt{L}\ \frac{(1+\beta K\alpha)(\sqrt{Ls})^2 + g}{(\sqrt{Ls})[(\sqrt{Ls})^2 + g]}$$

The adjustable artificial output is defined as $\Omega = x_T + \beta\phi$, $r_T$ is a speed reference given by a computer and $\beta$ is a weighting coefficient. Kv and K$\alpha$ are parameters determined for a given crane. The time constant of the simplified motor drive model is assumed to be zero. The angle $\phi$ is the angle of the rope relative to the vertical direction.

The system uses fixed-parameter control with a variable control interval. As the controller has fixed parameters, the control algorithm need only be computed once. After that, only the control interval and the gain are varied in accordance with the hoisting rope length. The control interval is proportional to the square root of the rope length, as shown by equation 2. The constant parameters are preset for a given rope length, i.e. the reference length. The control interval is of the order of 100 ms.

The present invention provides simplicity of control as there is no need to recalculate control parameters during the hoisting and/or traveling of the trolley. Control of the system is performed by scaling the control interval in a real timing continuous fashion to be the pendulum-frequency to the suspended load. Thus, the entire control law is scaled with varying rope length, making scaling of other control parameters unnecessary. The method of the present invention therefore allows the control parameters to be invariant, considerably simplifying sway control.

It is obvious to the person skilled in the art that different embodiments of the invention are not restricted to the example described above, but that they may instead be varied within the scope of the following claims. The damping procedure of the invention is also applicable in open systems. The discrete time control of the control interval can be implemented e.g. using a computer with a suitable control program as illustrated in Step S4 of FIG. 3.

What is claimed is:

1. A method of damping load sway in a crane having a load suspended on a hoisting cable from a movable carriage comprising:

a. determining the length of said cable, said cable varying in length during movement of the moveable carriage;

b. controlling the carriage position to a desired position with a transfer function;

c. varying the dampening control interval as a function of the length of the cable determined by said step a. to thereby control load sway without requiring transfer function recalculation; and d. repeating said steps a., b. and c. to control carriage position to a desired position while controlling load sway at a frequency determined by the dampening control interval as established by varying the length of said cable.

2. A method according to claim 1, wherein said method develops a single control signal based on said damping control interval, carriage position and the swing angle of the load being controlled by the single control signal.

3. The method according to claim 2, wherein said transfer function sums the swing angle and the carriage position.

4. A method according to claim 2, wherein the swing angle and the carriage position are summed by multiplying at least one of the swing angle or the carriage position by a weighting coefficient.

5. A method according to claim 4, wherein said control interval is proportional to the square root of said determined length of said cable.

6. A method according to claim 2, wherein said control interval is proportional to the square root of said determined length of said cable.

7. The method according to claim 2, wherein said damping control interval is determined from only constant parameters and determined cable length.

8. A method according to claim 7, wherein said constant parameters are preset for a given length of said cable.

9. A method according to claim 1, wherein said control interval is proportional to the square root of said determined length of said cable.

* * * * *